US005897026A

United States Patent [19]

Vester et al.

[11] Patent Number: 5,897,026

[45] Date of Patent: Apr. 27, 1999

[54] SINGLE-USE PERSONAL DEFENSE DEVICE

[76] Inventors: John J Vester; Kathy R Vester, both of 436 Maria Dr., Greenwood, Ind. 46143

[21] Appl. No.: 08/821,202

[22] Filed: Mar. 20, 1997

[51] Int. Cl.[6] ..... B65D 83/18; B65D 83/22

[52] U.S. Cl. ..... 222/5; 222/83; 222/83.5; 222/402.11

[58] Field of Search ..... 222/5, 82, 83, 222/83.5, 402.1, 402.11, 175, 192

[56] References Cited

U.S. PATENT DOCUMENTS

| | | | |
|---|---|---|---|
| 2,545,991 | 3/1951 | Cooper et al. | 222/5 X |
| 4,068,780 | 1/1978 | Fegley | 222/5 |
| 4,241,850 | 12/1980 | Speer | 222/82 X |
| 4,446,990 | 5/1984 | Stevenson et al. | 222/83.5 X |
| 5,348,193 | 9/1994 | Bruckner et al. | 222/402.1 X |
| 5,509,581 | 4/1996 | Parsons | 222/402.11 X |

*Primary Examiner*—Kenneth Bomberg

[57] ABSTRACT

A new single-use personal defense device for warding off, and marking, potential and actual attackers. The inventive device includes a housing containing a sealed container therein which contains a supply of pressurized attack-repellent chemical. The container includes a frangible surface which is pierced by a sharp piercing end of a hollow tube when the tube is actuated by a trigger. The chemical then flows through the hollow tube to a dispensing end where the chemical is discharged to the exterior of the housing. The chemical is an indelible dye and/or an odoriferous scent material, so that when sprayed onto an attacker, the attacker is marked by the chemical so that the attacker can be easily identified.

8 Claims, 2 Drawing Sheets

SINGLE-USE PERSONAL DEFENSE DEVICE

BACKGROUND OF THE INVENTION

1. Field of the Invention

The present invention relates to personal defense devices and more particularly pertains to a new single-use personal defense device for warding off, and marking, potential and actual attackers.

2. Description of the Prior Art

The use of personal defense devices is known in the prior art. More specifically, personal defense devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art personal defense devices include U.S. Pat. No. 5,088,624; U.S. Pat. No. 4,223,804; U.S. Pat. No. 4,044,922; U.S. Pat. No. 4,434,914; U.S. Pat. No. Des. 360,674; and U.S. Pat. No. 4,220,263.

While these devices fulfill their respective, particular objectives and requirements, the aforementioned patents do not disclose a new single-use personal defense device. The inventive device includes a housing containing a sealed container therein which contains a supply of pressurized attack-repellent chemical. The container includes a frangible surface which is pierced by a sharp piercing end of a hollow tube when the tube is actuated by a trigger. The chemical then flows through the hollow tube to a dispensing end where the chemical is discharged to the exterior of the housing. The chemical is an indelible dye and/or an odoriferous scent material, so that when sprayed onto an attacker, the attacker is marked by the chemical so that the attacker can be easily identified.

In these respects, the single-use personal defense device according to the present invention substantially departs from the conventional concepts and designs of the prior art, and in so doing provides an apparatus primarily developed for the purpose of warding off, and marking, potential and actual attackers.

SUMMARY OF THE INVENTION

In view of the foregoing disadvantages inherent in the known types of personal defense devices now present in the prior art, the present invention provides a new single-use personal defense device wherein the same can be utilized for warding off, and marking, potential and actual attackers.

The general purpose of the present invention, which will be described subsequently in greater detail, is to provide a new single-use personal defense device which has many of the advantages of the personal defense devices mentioned heretofore and many novel features that result in a new single-use personal defense device which is not anticipated, rendered obvious, suggested, or even implied by any of the prior art personal defense devices, either alone or in any combination thereof.

To attain this, the present invention generally comprises a housing containing a sealed container therein which contains a supply of pressurized attack-repellent chemical. The container includes a frangible surface which is pierced by a sharp piercing end of a hollow tube when the tube is actuated by a trigger. The chemical then flows through the hollow tube to a dispensing end where the chemical is discharged to the exterior of the housing. The chemical is an indelible dye and/or an odoriferous scent material, so that when sprayed onto an attacker, the attacker is marked by the chemical so that the attacker can be easily identified.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new single-use personal defense device which has many of the advantages of the personal defense devices mentioned heretofore and many novel features that result in a new single-use personal defense device which is not anticipated, rendered obvious, suggested, or even implied by any of the prior art personal defense devices, either alone or in any combination thereof.

It is another object of the present invention to provide a new single-use personal defense device which may be easily and efficiently manufactured and marketed.

It is a further object of the present invention to provide a new single-use personal defense device which is of a durable and reliable construction.

An even further object of the present invention is to provide a new single-use personal defense device which is susceptible of a low cost of manufacture with regard to both materials and labor, and which accordingly is then susceptible of low prices of sale to the consuming public, thereby making such single-use personal defense device economically available to the buying public.

Still yet another object of the present invention is to provide a new single-use personal defense device which provides in the apparatuses and methods-of the prior art some of the advantages thereof, while simultaneously overcoming some of the disadvantages normally associated therewith.

Still another object of the present invention is to provide a new single-use personal defense device for warding off, and marking, potential and actual attackers.

Yet another object of the present invention is to provide a new single-use personal defense device which includes a housing containing a sealed container therein which contains a supply of pressurized attackrepellent chemical. The container includes a frangible surface which is pierced by a sharp piercing end of a hollow tube when the tube is actuated by a trigger. The chemical then flows through the hollow tube to a dispensing end where the chemical is discharged to the exterior of the housing. The chemical is an indelible dye and/or an odoriferous scent material, so that when sprayed onto an attacker, the attacker is marked by the chemical so that the attacker can be easily identified.

Still yet another object of the present invention is to provide a new single-use personal defense device that provides peace of mind and security to a person carrying such a device.

Even still another object of the present invention is to provide a new single-use personal defense device that marks a would be, or actual, attacker for later identification.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
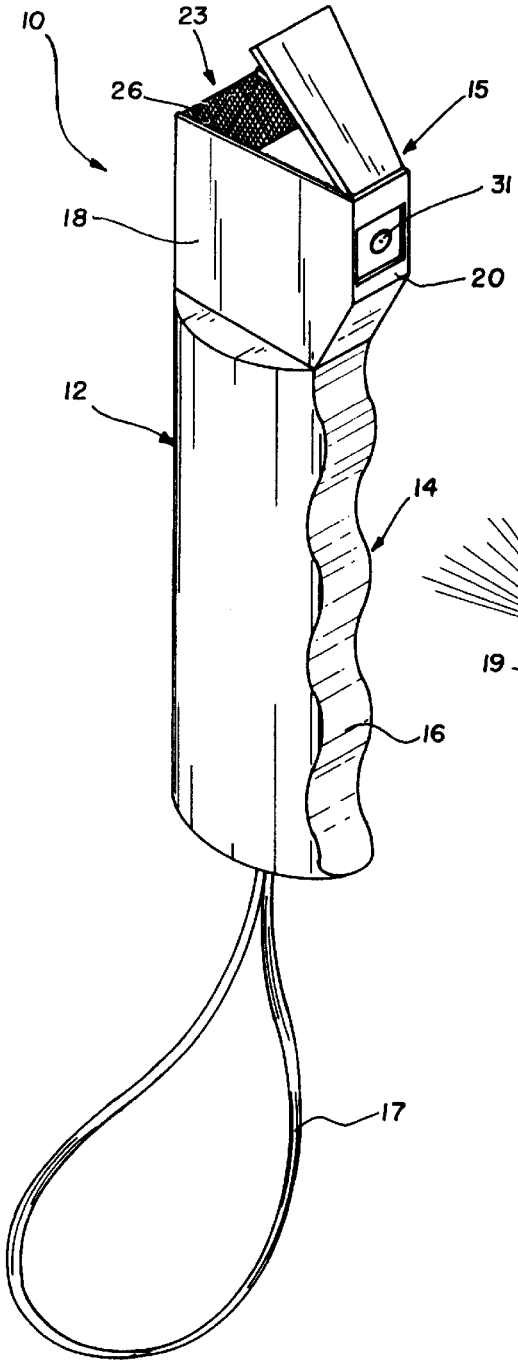
FIG. 1 is a perspective view of a new single-use personal defense device according to the present invention.
Figure 2:
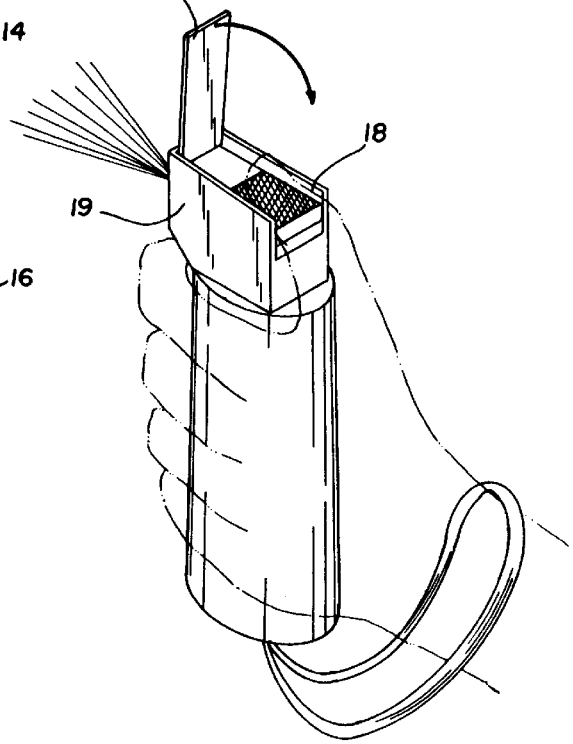
FIG. 2 shows the device in use being held by a user.
Figure 3:
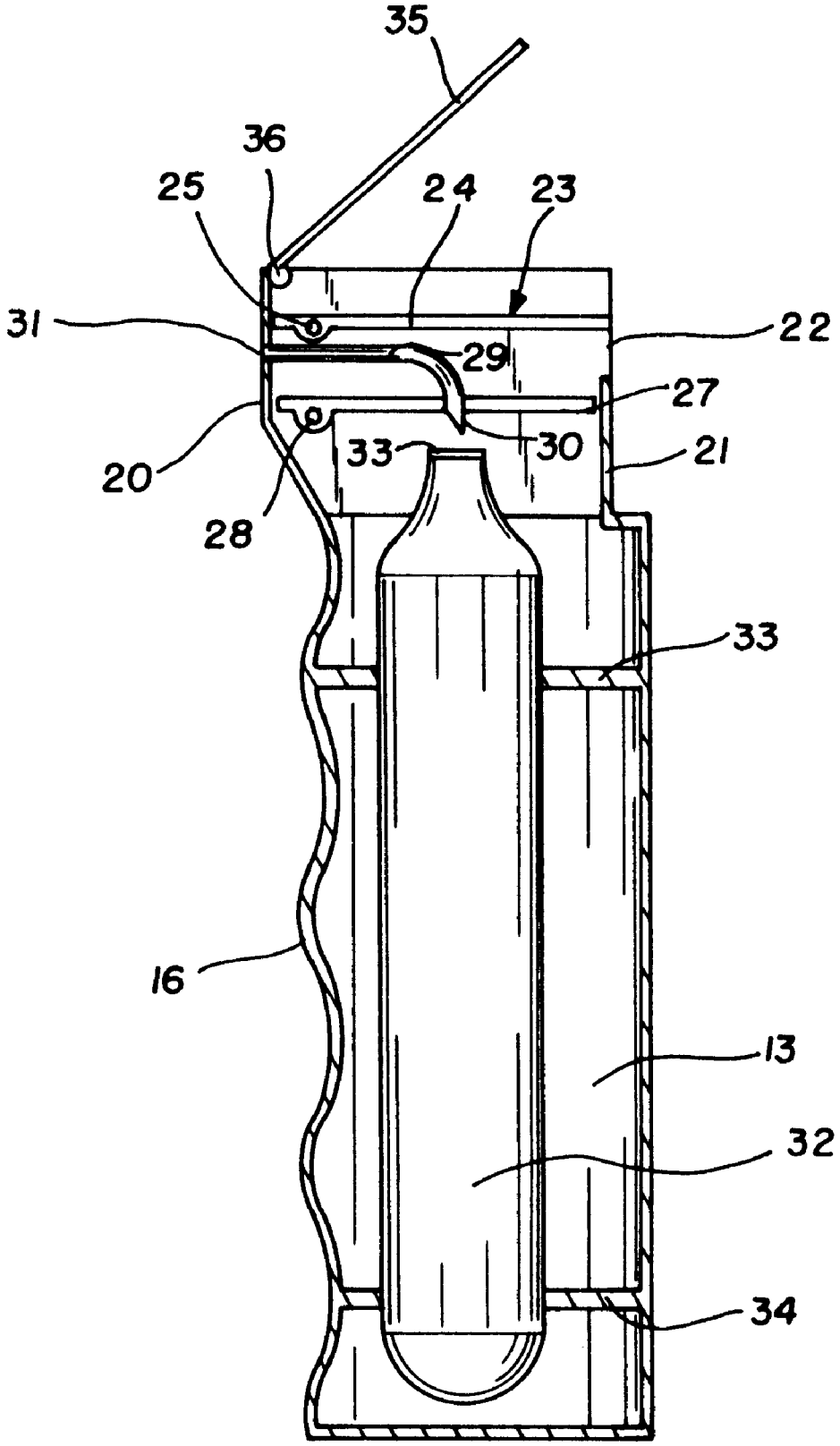
FIG. 3 is a sectional view of the device showing the components thereof.

With reference now to the drawings, and in particular to FIGS. 1 through 3 thereof, a new single-use personal defense device embodying the principles and concepts of the present invention and generally designated by the reference numeral 10 will be described.

As best illustrated in FIGS. 1 through 3, the single-use personal defense device 10 comprises an elongated housing 12 having a substantially hollow interior 13. The housing 12 includes a bottom, hand gripping portion 14 and an upper, dispensing portion 15. The gripping portion 14 includes an undulating surface 16 thereon which is configured for interaction with a user's fingers to improve the user's grip on the housing during use. A looped wrist strap 17 is fastened to the bottom of the housing 12 and is intended to be looped around the user's wrist, as illustrated in dashed lines in FIG. 2, during use.

The dispensing portion 15 is generally rectangular and includes a pair of side walls 18,19, a front wall 20, and a rear wall 21. The rear wall 21 does not extend completely to the top of the side walls 18,19 in order to define a slot 22 which permits pivoting movement of a trigger means 23 which is pivotally supported between the side walls. The trigger means 23 comprises a flap member 24 secured by pivot 25 to the side walls. An upper surface of the member 24 adjacent the slot 22 is roughened 26 in order to prevent slippage of a user's finger while pressing the member.

A support wall 27 is also pivotally secured by a pivot 28 between the side walls 18,19 below the trigger means 23. Hollow dispensing tube 29 is disposed within the housing between the flap member 24 and the support wall 27. The tube 29 includes a sharpened piercing end 30 which extends through a suitable aperture in the wall 27 and is supported thereby such that the end 30 moves with the pivoting movements of the wall 27. The tube 29 further includes a dispensing end 31 which is securely fastened within an aperture within the front wall 20, for dispensing material which enters the piercing end 30 to the exterior of the housing.

A sealed container 32 containing a supply of attack-repellent material under pressure therein is supported by stationary support walls 33,34 within the interior 13 of the housing. The attack-repellent material is preferably an indelible dye material and/or an odoriferous scent material like artificial skunk oil. The upper end of the container is located beneath the pivoting support wall 27, and includes a frangible surface 33 which is vertically aligned with the piercing end 30 of the hollow tube 29. The attack-repellent material is contained within the container 32 until such time that the frangible surface 33 is pierced by the piercing end 30, at which time the material flows into the tube 29 and is discharged out the dispensing end 31. Once the surface 33 is pierced, all the material will be discharged from the container, such that the container 32 will have to be replaced or the device 10 discarded.

In order to prevent actuation of the trigger means 23, a safety guard flap 35 is pivotally secured by a pivot 36 between the side walls 18,19 above the trigger means. The flap 35 pivots between a covering position where it is disposed over the member 24 to prevent its actuation, and a non-covering position (illustrated in FIG. 2) where the member 24 is able to be pressed/actuated. Normally, the flap 35 is in the covering position so that the device 10 will not function. The flap 35 must be pivoted to the non-covering position by the user in order to actuate the device 10.

In use, when the user is in a threatening situation, the user holds the gripping portion 14 of the housing with the dispensing end 31 pointed toward an attacker. The flap 35 is pivoted upward to expose the trigger member 24. When the member 24 is pressed downward, it contacts the tube 29 thus causing the tube to move downward. Since the piercing end 30 of the tube is secured to the pivoting support wall 27, the end 30 moves downward aided by the wall 27. When the end 30 is moved downward a sufficient distance, it pierces the frangible surface 33, which releases the pressurized attack-repellent material. The material flows into the tube and is dispensed out the end 31 to the exterior of the housing and in the direction of the attacker. Since the material is an indelible dye and/or an odoriferous scent material, the attacker is marked by the material for later identification.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A single-use personal defense device, comprising:

a housing having a substantially hollow interior;

a sealed container disposed within said hollow interior of the housing, said container holding a supply of attack-repellent chemical under pressure therein, and said container including a frangible surface;

a hollow dispensing tube supported within the interior of the housing, said hollow tube including a piercing end situated adjacent the frangible surface such that the piercing end is able to pierce the frangible surface when actuated such that the chemical in the container is dispelled through said dispensing tube by the release of pressure within the container when the container is pierced by the piercing end, said hollow tube further including a dispening end for dispensing the chemical to the exterior of the housing;

trigger means disposed for operative engagement with the hollow tube such that when said trigger means is pressed, the piercing end of said hollow tube pierces the frangible surface such that said chemical is propelled through the hollow tube by the release of pressure within the container and is dispensed through the dispensing end; and wherein said dispensing tube passes through a wall positioned beneath the trigger means for positioning the dispensing tube such that the piercing end is substantially aligned with the frangible surface, the wall being pivotally secured within the housing such that the piercing end and the wall pivot together when the trigger means actuates the hollow tube.

2. The single-use personal defense device of claim 1, wherein said housing is elongated and includes gripping means formed thereon for improving the grip on the housing by a user's hand.

3. The single-use personal defense device of claim 1, wherein said housing is elongated and includes gripping means formed thereon for improving the grip on the housing by a user's hand; and wherein said gripping means comprises an undulating frontal surface on said housing having at least four depressed areas, each depressed area being adapted for receiving a finger of the user's hand.

4. The single-use personal defense device of claim 1, wherein said chemical comprises at least one of an indelible dye and an odoriferous scent material.

5. The single-use personal defense device of claim 1, wherein said trigger means comprises a trigger member pivotally secured to the housing.

6. The single-use personal defense device of claim 1, further including a safety guard means for preventing actuation of the trigger means.

7. The single-use personal defense device of claim 6, wherein said safety guard means comprises a flap pivotally secured to the housing adjacent the trigger means such that the flap can pivot between a covering position wherein the flap is disposed over the trigger means and prevents actuation thereof, and a non-covering position wherein the flap is pivoted away from the trigger means to permit the insertion of a user's thumb between the flap and the trigger means to permit actuation of the trigger means by the user's thumb.

8. A single-use personal defense device, comprising:

a housing having a substantially hollow interior;

a sealed container disposed within said hollow interior of the housing, said container holding a supply of attack-repellent chemical under pressure therein, and said container including a frangible surface;

a hollow dispensing tube supported within the interior of the housing, said hollow tube including a piercing end situated adjacent the frangible surface such that the piercing end is able to pierce the frangible surface when actuated such that the chemical in the container is dispelled through said dispensing tube by the release of pressure within the container when the container is pierced by the piercing end, said hollow tube further including a dispensing end for dispensing the chemical to the exterior of the housing;

trigger means disposed for operative engagement with the hollow tube such that when said trigger means is pressed, the piercing end of said hollow tube pierces the frangible surface such that said chemical is propelled through the hollow tube by the release of pressure within the container and is dispensed through the dispensing end;

wherein said dispensing tube passes through a wall positioned beneath the trigger means for positioning the dispensing tube such that the piercing end is substantially aligned with the frangible surface, the wall being pivotally secured within the housing such that the piercing end and the wall pivot together when the trigger means actuates the hollow tube;

wherein said housing is elongated and includes gripping means formed thereon for improving the grip on the housing by a user's hand;

wherein said gripping means comprises an undulating frontal surface on said housing having at least four depressed areas, each depressed area being adapted for receiving a finger of the user's hand;

wherein said chemical comprises at least one of an indelible dye and an odoriferous scent material;

wherein said trigger means comprises a trigger member pivotally secured to the housing;

a safety guard means for preventing actuation of the trigger means; and wherein said safety guard means comprises a flap pivotally secured to the housing adjacent the trigger means such that the flap can pivot between a covering position wherein the flap is disposed over the trigger means and prevents actuation thereof, and a non-covering position wherein the flap is pivoted away from the trigger means to permit the insertion of a user's thumb between the flap and the trigger means to permit actuation of the trigger means by the user's thumb.

* * * * *